United States Patent [19]

Averill

[11] 4,329,612

[45] May 11, 1982

[54] BRUSHHOLDER

[75] Inventor: Richard R. Averill, Greenfield, Mass.

[73] Assignee: Ingersoll-Rand Company, Woodcliff Lake, N.J.

[21] Appl. No.: 152,795

[22] Filed: May 23, 1980

[51] Int. Cl.[3] ..... H01R 39/38

[52] U.S. Cl. ..... 310/247; 310/239

[58] Field of Search ..... 310/239, 242, 245, 247, 310/249

[56] References Cited

U.S. PATENT DOCUMENTS 2,548,631 4/1951 Stapleton ..... 310/247

2,987,639 6/1961 Bayless et al. ..... 310/247

3,329,844 7/1967 Happe ..... 310/247

*Primary Examiner*—J. D. Miller

*Assistant Examiner*—Donald L. Rebsch

*Attorney, Agent, or Firm*—Walter C. Vliet

[57] ABSTRACT

A brushholder and carbon brush combination for use with electric motors and the like as a contact with rotating commutators. The brush assembly is provided with a unique locking tab which cooperates with the brushholder to provide both contact between the brush and the brushholder and to retain the brush in its cooperating position within the brushholder absent contact with the commutator.

10 Claims, 9 Drawing Figures

FIG. 3
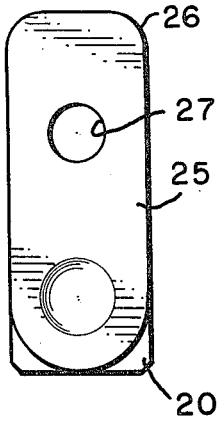
FIG. 2
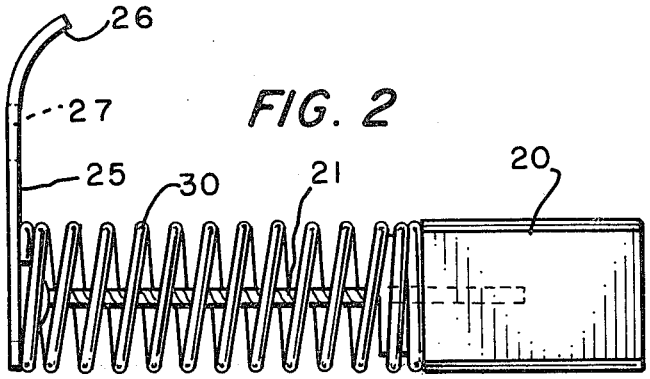
FIG. 4
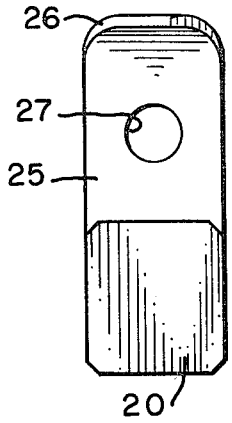
FIG. 6
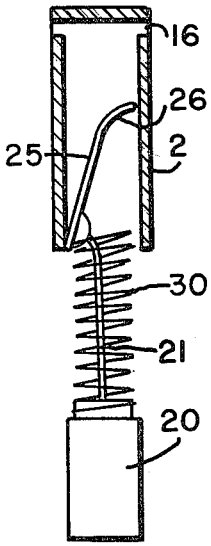
FIG. 7
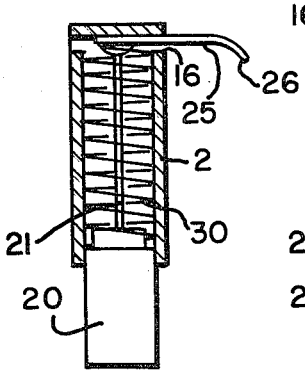
FIG. 8
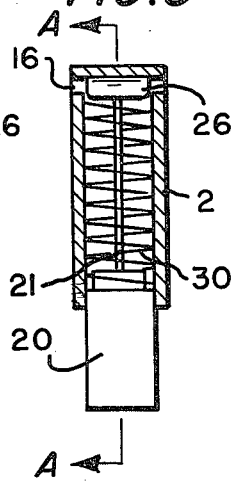
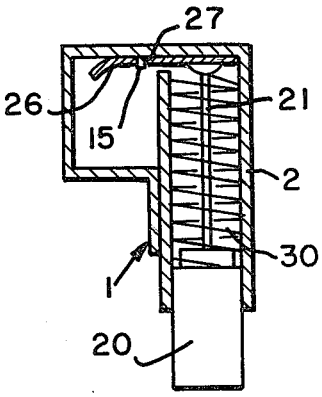
FIG. 9
FIG. 5
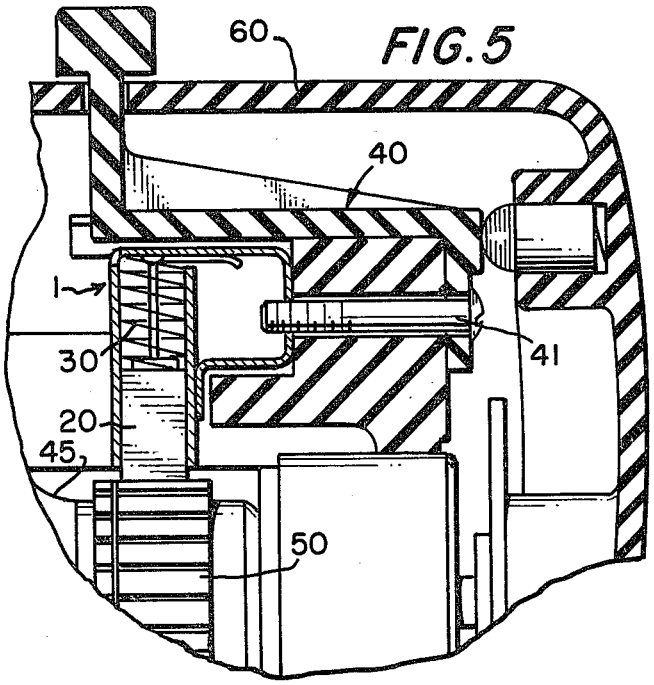
FIG. 1
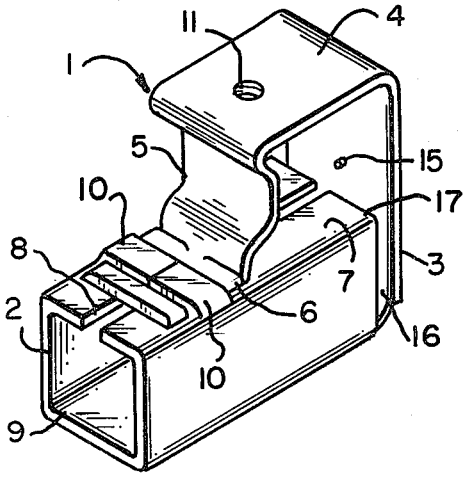

BRUSHHOLDER

BACKGROUND OF THE INVENTION

Previous brushholder constructions were of two basic types. The first type employs a brush tube with both ends open. The brush assembly, comprising a carbon block, shunt, spring, and contact terminal is inserted into the tube from the end away from the commutator or slip ring. The terminal is clamped into place using a brush cap, clip, pin or other secondary part. This clamping anchors the shunt so that the brush travel can be limited, and it provides an electric contact between the terminal and the brushholder or other conductor.

The second type requires the brush to be loaded into the tube from the commutator or slip ring end. When shunted brushes have been used in these dead-ended tubes, something had to be pushed through a hole in the tube to hold back the spring or terminal in order to limit brush travel. This type of unit will retain the brush and the spring only after the secondary connection is made.

SUMMARY OF THE INVENTION

In the present invention, there are only two main parts; the brushholder and the brush assembly having a locking terminal. The brush is put into the holder, and the terminal is locked into place by a simple rotation of the locking terminal. The locking terminal further limits brush travel by the shunt and provides an electrical connection between the brush and the brushholder. The connection is perfected without permanently deforming any part and without making any permanent connection. The terminal may easily be unlocked and the brush removed from the holder for reassembly or maintenance purposes.

The object of this invention is to provide a simple, convenient and reliable brushholder for electric motors and the like. A further object of the invention is to provide a brushholder which secures the brush in a simple, reliable and economical manner.

It is the object of this invention to provide a locking terminal in the carbon brush assembly which cooperates with the brushholder to secure the carbon brush within the brushholder, and to provide a reusable connection between the brush assembly and the brushholder.

These and other objects are obtained in a brushholder assembly comprising: A brushholder of generally tubular form; an end cap enclosing one end of the brushholder leaving a radial gap partially about the one end of the holder; a means for reducing the radial gap in at least one portion of the radial gap; a brush inserted in the brushholder from its other end; a terminal attached to the brush; and the terminal securing the brush in the brushholder by insertion of the terminal through the radial gap and rotating the terminal to a position engaging the means for reducing the radial gap.

BRIEF DESCRIPTION OF THE DRAWINGS

FIG. 1 is a perspective view of the brushholder according to the invention as viewed from slightly below and to the rear or mounting side of the brushholder;

FIG. 2 is a side view of the carbon brush assembly according to this invention;

FIG. 3 is a top view of the carbon brush assembly to this invention.

FIG. 4 is a bottom view of the brushholder assembly according to this invention;

FIG. 5 is a partially sectioned side elevation of the brushholder and carbon brush assembly as mounted in its operating position within an electric-motor driven power tool;

FIG. 6 is a partially sectioned front elevation view showing the initial insertion of the carbon brush assembly into the brushholder;

FIG. 7 is a partially sectioned front elevation showing the carbon brush assembly inserted in the brushholder prior to locking the brush assembly in place;

FIG. 8 is a partially sectioned side elevation showing the carbon brush assembly inserted in the brushholder and having the locking terminal rotated 90 degrees into its locking position; and FIG. 9 is a side elevation taken at Section A—A of FIG. 8.

DESCRIPTION OF THE PREFERRED EMBODIMENT

As shown in FIG. 1, a brushholder assembly indicated by numeral 1 is formed with a square cross section hollow tube portion 2. One side of the hollow tube is extended and bent rearward to form a top cap 3, a back 4, a web 5, and a clamping pad 6. The back side of the hollow tube 7 contains the assembly parting line 8 which essentially divides the back side 7 into two halves. The parting line runs from the bottom 9 of the hollow tube to the underside of the top cap 3. Each of the back side halves is provided with a clamping tab 10, which cooperates with the clamping pad 6 to secure and reenforce the assembly in the form shown.

The brushholder assembly is manufactured from an electrically conductive material, such as brass. To provide a means of mounting the brushholder, mounting screw hole 11 is provided in the back 4 of the brushholder. The mounting screw hole is preferably threaded to receive a mounting screw. The top cap on its bottom side is provided with a locking projection 15, the function of which will be later described.

Referring now to FIG. 2, a carbon brush 20 is attached to a shunt 21, which is formed from a piece of flexible conductive wire. The shunt is in turn connected to a locking terminal 25, which in the preferred embodiment is a piece of brass stock formed in the shape shown in FIGS. 2 and 3, that is essentially flat with one downwardly curved end 26. The locking terminal is provided with a locking hole 27, which in its assembled position cooperates with locking projection 15 in the brushholder. The means of connecting the shunt to the locking terminal and the carbon brush are well known in the electric motor industry and need not be described here.

Interspaced between the carbon brush and the locking terminal and limited in its extension to the length of the shunt 21 is a brush spring 30. The brush spring biases the carbon brush against the commutator of the electric motor in normal operation.

FIG. 4 shows the bottom view of the carbon brush assembly which includes the following components: carbon brush 20, shunt 21, locking terminal 25 and the brush spring 30.

FIG. 5 shows the typical mounting of the brushholder with the carbon brush assembly inserted in a typical electric power tool. The brushholder is mounted to a reversing carriage assembly 40 by means of a mounting screw 41. The reversing carriage assembly is mounted for limited rotary movement about the axis of the motor rotor 45 by a means well known in the industry. The carbon brush is shown contacting the commutator 50, which is attached to the motor rotor, and which rotates about the motor rotor axis with the motor rotor. The power tool housing 60 contains the entire motor assembly and need not be further described.

FIG. 6 shows the initial insertion of the carbon brush assembly into the hollow tube portion 2 of the brushholder. The partially sectioned brushholder is positioned as viewed from the back side. As the brush assembly is inserted in the brushholder, the locking tab preceeds the assembly to the top cap of the brush assembly. By virtue of its spring loaded relationship with the brush spring 30 and its curved end 26, the locking terminal 25, when it reaches the top cap, it is deflected to the right as shown in FIG. 7 and projects out through the slot or radial gap 16 (as best seen on FIG. 1) to the position shown on FIG. 7.

The locking terminal is then rotated 90 degrees about the axis formed by the hollow tube with the curved end 26 turned towards the rear of the brushholder. The clearance between the top 17 of the hollow tube 2 and the top cap 3 is reduced by the locking projection 15, which is slightly offset from the top of the hollow tube, and is such as to provide a slight interference fit when the locking terminal is rotated. Once the locking terminal is rotated fully 90 degrees into position, the locking projectin snaps into the locking hole or perforation 27. This snapping action secures the locking terminal in the rotated position as shown in FIG. 9. It also prevents the locking terminal from being withdrawn through the hollow tube, and by means of the shunt connection secures the brush in the brushholder.

Although I have described my invention in terms of a preferred embodiment, I do not wish to be limited in the scope of my invention except as claimed.

I claim:

1. A brushholder assembly comprising:

a brushholder of generally tubular form;

an end cap enclosing one end of said brushholder leaving a radial gap partially about said one end of said holder;

a means for reducing said radial gap in at least one portion of said radial gap;

a brush inserted in said brushholder from its other end;

a terminal attached to said brush; and said terminal securing said brush in said brushholder by insertion of said terminal through said radial gap and rotating said terminal to a position engaging said means for reducing said radial gap.

2. A brushholder assembly according to claim 1 wherein:

said brushholder is of generally rectangular, tubular form having one side extended and bent over at an appropriate radius to form said end cap.

3. A brushholder assembly according to claim 2 wherein:

said radial gap is formed between said end cap and three sides of said rectangular brushholder.

4. A brushholder assembly according to claim 1 wherein:

said means for reducing said radial gap is a dimpled projection from said end cap.

5. The brushholder assembly according to claim 4 wherein:

said end cap extends beyond the edge of said brushholder; and said dimpled projection is beyond the edge of said brushholder.

6. The brushholder assembly according to claim 1 wherein:

said brush is attached to said terminal by a shunt.

7. The brushholder assembly according to claim 1 wherein:

said brush is biased towards said other end of said brushholder by a spring.

8. The brushholder assembly according to claim 6 wherein:

said shunt is attached to said terminal towards one end of said terminal; and said terminal has a curved portion opposite said connection to facilitate securing of said terminal through said radial gap in said brushholder.

9. The brushholder assembly according to claim 8 wherein:

a spring is interspaced between said brush and said terminal.

10. The brushholder assembly according to claim 4 wherein:

said terminal is provided with a recess which cooperates with said dimpled projection.

* * * * *